US007375465B2

(12) United States Patent
Chen

(10) Patent No.: US 7,375,465 B2
(45) Date of Patent: May 20, 2008

(54) PLASMA DISPLAY PANEL WITH SINGLE SIDED DRIVING CIRCUIT

(75) Inventor: Bi-Hsien Chen, Ping-Tung Hsien (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 0 days.

(21) Appl. No.: 10/908,612

(22) Filed: May 19, 2005

(65) Prior Publication Data

US 2006/0261736 A1 Nov. 23, 2006

(51) Int. Cl.
*H01J 17/49* (2006.01)

(52) U.S. Cl. ..... 313/583; 313/582; 313/586; 313/587; 313/584

(58) Field of Classification Search ..... 313/582–587
See application file for complete search history.

(56) References Cited

U.S. PATENT DOCUMENTS

| | | | | |
|---|---|---|---|---|
| 5,892,492 | A * | 4/1999 | Osawa et al. | 345/60 |
| 6,160,605 | A * | 12/2000 | Murayama et al. | 349/152 |
| 6,169,363 | B1 * | 1/2001 | Mori et al. | 313/582 |
| 6,507,150 | B1 * | 1/2003 | Lin et al. | 313/586 |
| 2002/0027417 | A1 * | 3/2002 | Mori et al. | 313/582 |
| 2002/0041155 | A1 * | 4/2002 | Asami et al. | 313/583 |
| 2002/0190652 | A1 * | 12/2002 | Do et al. | 313/587 |
| 2005/0012729 | A1 * | 1/2005 | Shin et al. | 345/204 |
| 2005/0110406 | A1 * | 5/2005 | Jeong et al. | 313/582 |
| 2006/0049769 | A1 * | 3/2006 | Min | 315/169.3 |

FOREIGN PATENT DOCUMENTS

| | | | |
|---|---|---|---|
| EP | 1233396 | A2 * | 8/2002 |
| JP | 05290742 | A * | 11/1993 |
| JP | 2001265242 | A * | 9/2001 |

* cited by examiner

*Primary Examiner*—Mariceli Santiago
(74) *Attorney, Agent, or Firm*—Winston Hsu

(57) ABSTRACT

A plasma display panel includes a first and a second substrate, a plurality of first sustain electrodes and second sustain electrodes formed in parallel on the first substrate, a plurality of address electrodes formed on the second substrate, and a flexible printed circuit (FPC) having a plurality of bonding pads formed at one side of the FPC. The first sustain electrodes and second sustain electrodes form a plurality of sustain electrode pairs. The first sustain electrodes have a plurality of first electrode terminals and the second sustain electrodes have a plurality of second electrode terminals formed on one end of the first substrate. The address electrodes extend in a direction intersecting the plurality of first sustain electrodes and second sustain electrodes. The plurality of bonding pads formed at one side of the FPC are coupled to the plurality of first electrode terminals and second electrode terminals.

9 Claims, 5 Drawing Sheets

PLASMA DISPLAY PANEL WITH SINGLE SIDED DRIVING CIRCUIT

BACKGROUND OF INVENTION

1. Field of the Invention

The present invention relates to a plasma display panel (PDP) for a plasma display device, and more particularly, to a PDP with a single-sided driving circuit structure.

2. Description of the Prior Art

Invented in 1897, the cathode ray tube (CRT) has been used for the vast majority of televisions and is still the most common display type today. In a CRT television a gun controlled by a video signal fires electron beams toward phosphors covering the surface of a vacuum tube, and an image is produced by lighting up different areas of the phosphor coating with different colors at different intensities. Though a simple and mature device, the CRT features several drawbacks such as bulky size, weight, and high power consumption. The high-voltage field, oscillating magnetic field, and X-rays generated by electrons hitting the screen have been regarded as hazardous for long-term use.

Recently flat panel display (FPDs) with their flat, thin form factor and high-resolution image quality are getting more and more attention and undergoing explosive growth in the consumer market. The major types of FPDs include the plasma display panel (PDP), the liquid crystal display (LCD), and the rear projection display, featuring several shared benefits (their flat, thin form factor and undistorted, fixed-pixel image rendering) and their own unique advantages. Among them PDP continues to best fill the needs of home theater enthusiasts seeking premium-quality large-screen display devices due to several inherent benefits of the technology: premium display quality with rich, accurate and lifelike colors; wide viewing angle with equivalently stunning brightness; high contrast in both light and dark rooms; and excellent motion handling and screen integrity over the long haul. As a result PDP technology remains the benchmark and de facto standard that consumers seek when considering the purchase of flat panel home theater display devices.

A typical PDP has two parallel sheets of glass, which enclose a gas mixture usually composed of neon and xenon that is contained in millions of tiny cells sandwiched in between the glass. Electricity, sent through an array of electrodes that are in close proximity to the cells, excites the gas, resulting in a discharge of ultraviolet light. The light then strikes a phosphor coating on the inside of the glass, which causes the emission of red, blue or green visible light. According to the driving methods, there are two kinds of plasma display device: an alternating current (AC) plasma display device and a direct current (DC) plasma display device. These are defined depending on whether the polarity of voltage applied to maintain discharge is varied with time or not. The AC plasma display device is the mainstream of this display technology because of lower power consumption and longer lifetime.

An AC plasma display device comprises a PDP having two glass substrates disposed opposite to each other and a circuit for controlling and driving the PDP. One of the two glass substrates has a plurality of address electrodes disposed in parallel, and the other glass substrate has a plurality of sustain electrodes disposed in parallel and perpendicular to the address electrodes. The sustain electrodes include a plurality of common electrodes (X-electrodes) and a plurality of scan electrodes (Y-electrodes). Display cells are formed between adjacent X-electrodes and Y-electrodes.

The circuit part includes several driving circuits for supplying driving voltages to the electrodes of the substrate. The electrodes of the glass substrates are formed linearly in such a manner as to extend substantially across the substrates, and electrode terminals are formed at the ends of the glass substrates. The driving circuits are disposed on a chassis mounted on the outer surface of one of the glass substrates, whereby the driving circuits are disposed within an area occupied by the glass substrate having a large area, this helping prevent a further increase in the overall size of the plasma display device. In other words, the plane in which the electrode terminals of the glass substrate are disposed is different from the plane in which the driving circuits are disposed. Therefore the use of flexible printed circuits (FPCs) is reasonable and effective for connecting the electrode terminals of the glass substrate with the driving circuits on the chassis. A plurality of bonding pads are disposed on one end of a flexible printed circuit and connected to the electrode terminals of the glass substrate, while the other end of the FPC is connected to the driving circuits directly or via an intermediate circuit board connected to the driving circuit, with the intermediate portions of the FPC being bent.

FIG. 1 is a perspective view showing a part of a conventional PDP 10. The PDP 10 includes two glass substrates 12 and 14, a plurality of address electrodes 16 arranged parallel to each other on one glass substrate 12, and a plurality of sustain electrodes 18 arranged, on the other glass substrate 14, parallel to each other and perpendicular to the address electrodes 16. The driving circuits are disposed on a chassis 13 mounted on the outer surface of the glass substrate 12. An FPC 35 and an FPC 37 are used to connect the sustain electrodes 18 of the glass substrate 14 to the driving circuits on the chassis 13.

FIG. 2 is a schematic view of a prior art PDP 20. The PDP 20 includes a plurality of X-electrodes 22 and a plurality of Y-electrodes 24 formed in parallel on a glass substrate 14, a plurality of address electrodes 16 formed on another glass substrate 12 disposed opposite to the glass substrate 14, a plurality of X-electrode terminals 32, a plurality of Y-electrode terminals 34, two FPCs 42 and 44, two driving circuits 52 and 54, and a control board 60. In the PDP 20, adjacent X-electrodes 22 and Y-electrodes 24 form a plurality of sustain electrode pairs, which form a plurality of display cells 55 with the address electrodes 16. The X-electrode terminals 32 are formed at one end of the glass substrate 14 and the Y-electrode terminals 34 are formed at the other end. In other words, each sustain electrode pair has two electrode terminals formed at the opposite end on the glass substrate 14. Since the terminals of the electrode pairs are located at different sides of the glass substrate, two FPCs 42 and 44 are required for connection. The FPC 42 connects the X-electrode terminals 32 to an X driving circuit 52 through a plurality of bonding pads 62 disposed on the FPC 42, and the FPC 44 connects the Y-electrode terminals 34 to a Y driving circuit 54 through a plurality of bonding pads 64 disposed on the FPC 44. A control board 60 sends signals to the X driving circuit 52 and the Y driving circuit 54 for PDP operations.

The prior art PDP 20 has several drawbacks: The PDP 20 needs two FPCs and two driving circuits that increase manufacturing cost and lower production yield. Due to different locations at the opposite sides of the substrate, the two driving circuits receive signals with different amounts of delay from the control board and this largely influences PDP performance. Also, magnetic interference caused by driving circuits affects a larger area in this two-sided-FPC structure.

SUMMARY OF INVENTION

It is therefore an objective of the claimed invention to provide a PDP using a single FPC and a single-sided driving circuit structure, in order to solve the problems of the prior art.

The claimed invention discloses a plasma display panel (PDP) comprising a first substrate and a second substrate disposed opposite to each other, a plurality of first sustain electrodes and second sustain electrodes formed in parallel on the first substrate, a plurality of address electrodes formed on the second substrate, and a flexible printed circuit (FPC) having a plurality of bonding pads formed at one side of the FPC. The first sustain electrodes and the second sustain electrodes form a plurality of sustain electrode pairs, the first sustain electrodes having a plurality of first electrode terminals and the second sustain electrodes having a plurality of second electrode terminals formed on one end of the first substrate. The address electrodes extend in a direction intersecting the plurality of first sustain electrodes and second sustain electrodes. The plurality of bonding pads formed at one side of the FPC are coupled to the plurality of first electrode terminals and second electrode terminals.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
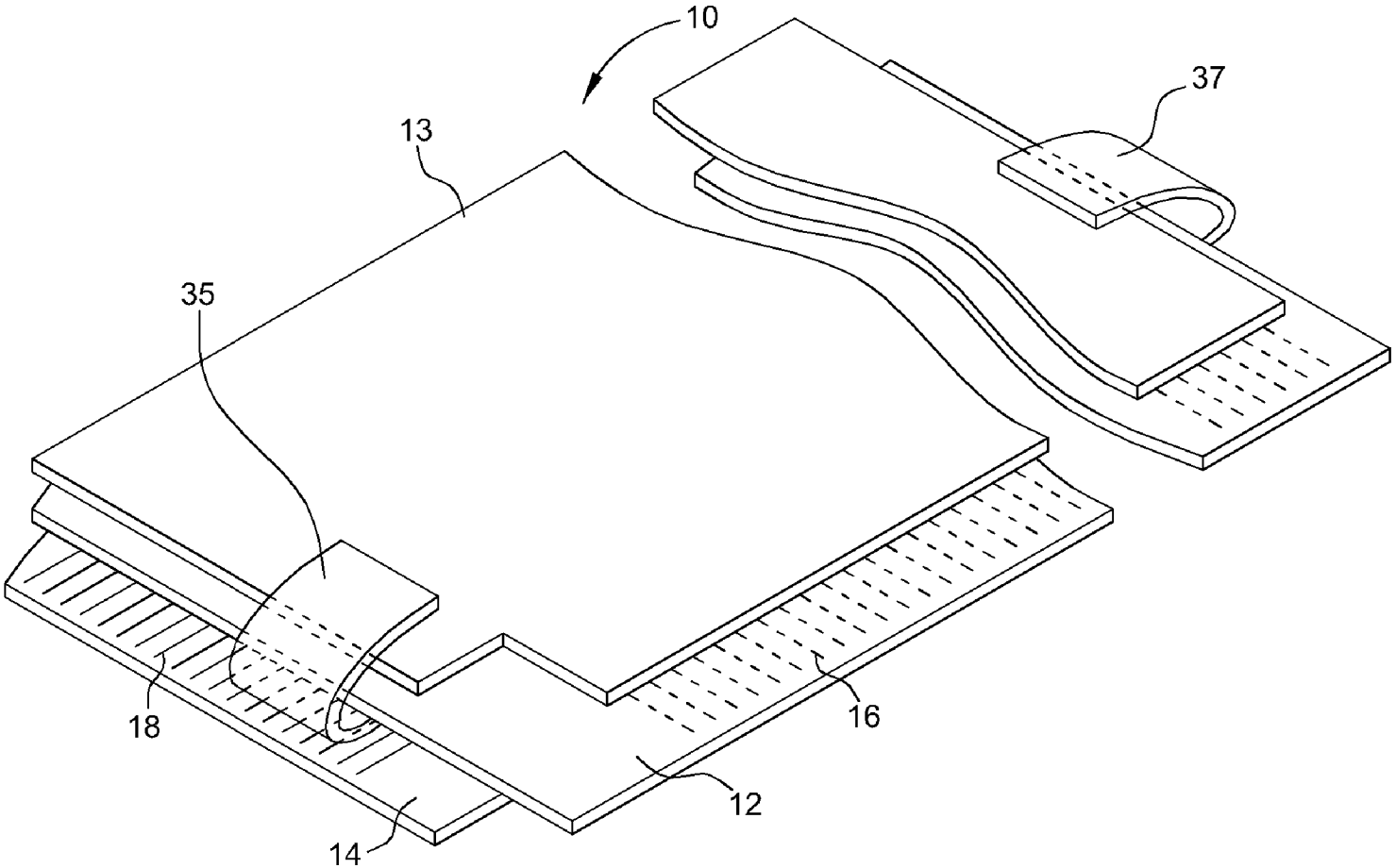
Fig. 1 Prior Art
FIG. 1 is a perspective view showing a part of a prior art PDP.
Figure 2:
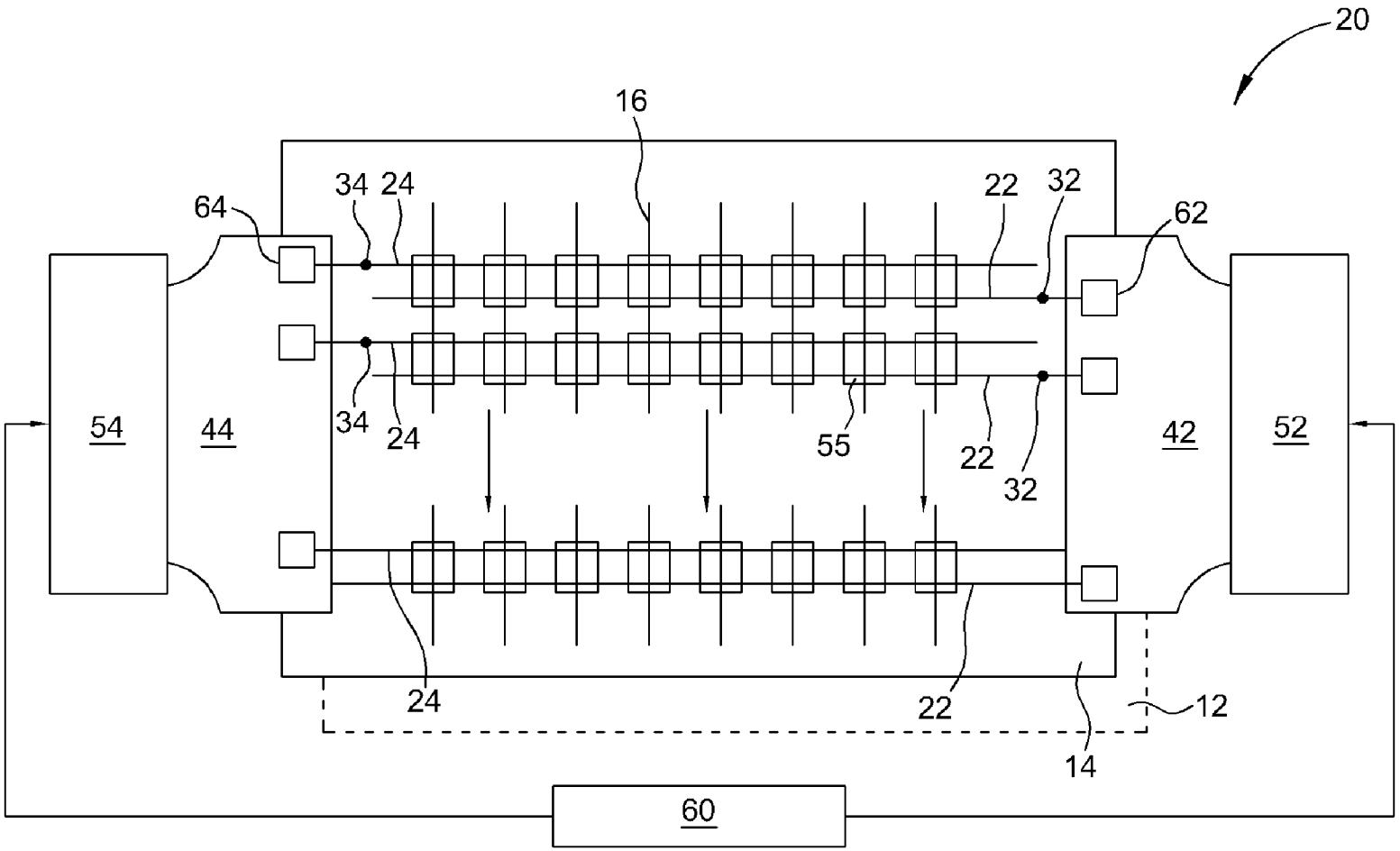
Fig. 2 Prior Art
FIG. 2 is a schematic view of a prior art PDP.
Figure 3:
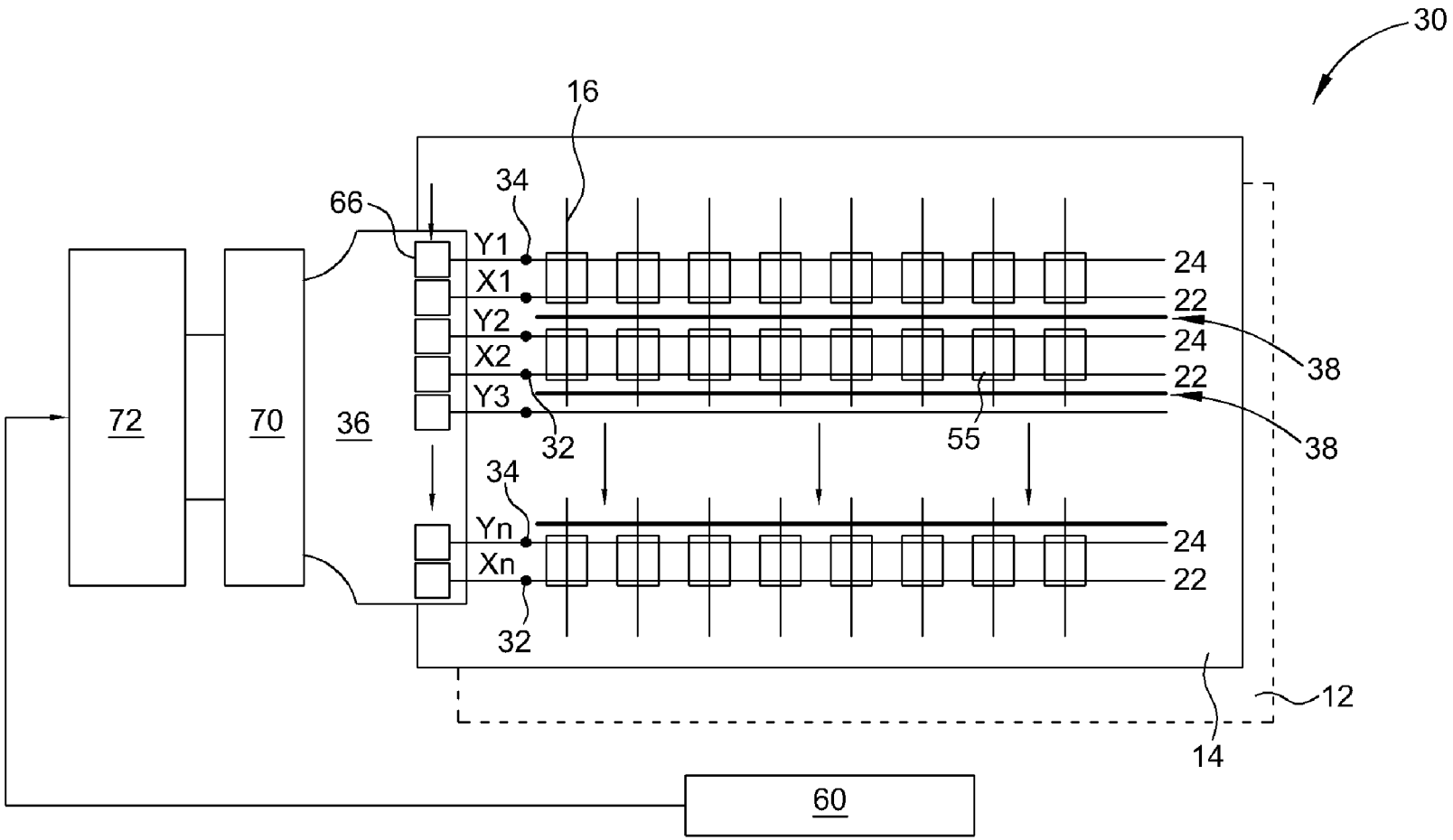
FIG. 3 is a schematic view of a PDP of the present invention.

FIG. 3 is a schematic view of a PDP 30 of the present invention. The PDP 30 includes a plurality of X-electrodes 22 and a plurality of Y-electrodes 24 formed in parallel on a glass substrate 14, a plurality of address electrodes 16 formed on another glass substrate 12 disposed opposite to the glass substrate 14, a plurality of X-electrode terminals 32, a plurality of Y-electrode terminals 34, a flexible printed circuit (FPC) 36, a scan IC 70, a driving circuit 72 and a control board 60. In the PDP 30, adjacent X-electrode 22 and Y-electrode 24 form a plurality of sustain electrode pairs, which form a plurality of display cells 55 with the address electrodes 16. A plurality of black matrices 38 can be formed in parallel with the X-electrodes 22 and the Y-electrodes 24 on the glass substrate 14, between each electrode pair and the display cells 55 so as to increase the contrast performance of the PDP 30.

In the PDP 30 of the present invention, the X-electrode terminals 32 and the Y-electrode terminals 34 are formed at the same end of the glass substrate 14, which means each electrode pair has two electrode terminals formed on the same end of the glass substrate 14. As a result, only one FPC 36 is required for connection and only one driving circuit 72 is required for driving the PDP 30. The FPC 36 includes a plurality of bonding pads 66 connected to the X-electrode terminals 32 and the Y-electrode terminals 34. Thus, one end of the FPC 36 is coupled to the X-electrode terminals 32 and the Y-electrode terminals 34 of the glass substrate and the other end of the FPC 36 is coupled to the driving circuit 72 via the intermediate scan IC 70, with the intermediate portions of the FPC 36 being bent. A control board 60 sends signals to the driving circuit 72 for PDP operations. The functions of the X driving circuit 52 and the Y driving circuit 54 in the prior art PDP 20 are integrated into the driving circuit 72 of the present invention, so that only one driving circuit board is needed. Also, the FPC 36 can couple the X-electrodes 22 and the Y-electrodes 24 directly to the driving circuit 64 without the intermediate scan IC 70.

Compared to the prior art PDP 20, in the PDP 30 of the present invention only one FPC and one driving circuit are needed and thus the manufacturing cost can be lowered. Due to fewer FPCs and circuit boards required for producing a PDP of the present invention, the manufacturing process can be simplified and the production yield can be improved. The control board 60 only sends signals to the driving circuit 72, so the problem of different signal delays in the prior art can be solved. Also, since the driving circuit 72 is located at one side of the glass substrate instead of both sides, it contributes less magnetic interference to the PDP 30.

Figure 4:
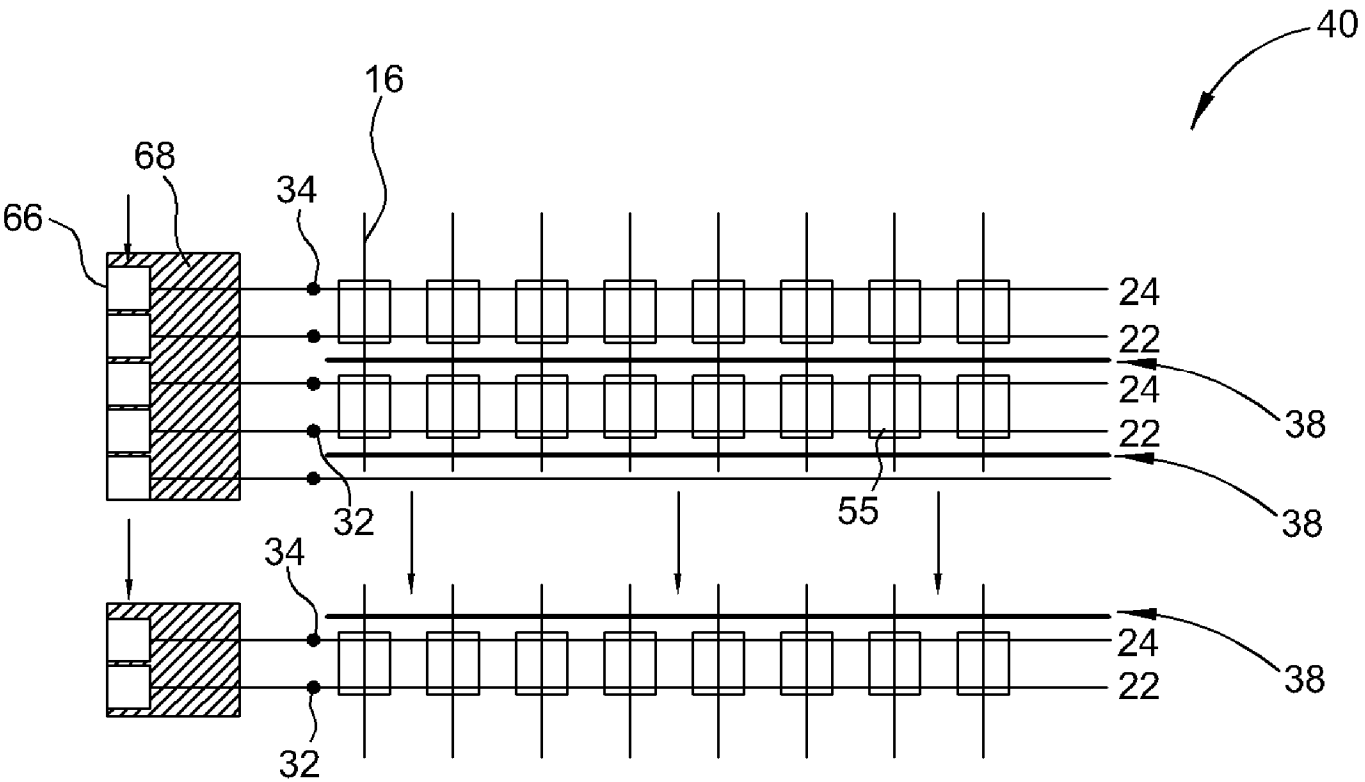
FIG. 4 is a schematic view of another embodiment of the PDP of the present invention.

During PDP operation, if there is a large voltage difference between an X-electrode and a Y-electrode, existing moisture or small particles might result in arc discharges, burning down the electrodes. Undesired capacitive interactions between two adjacent electrodes, so-called cross talk, also affect PDP performance. To solve the problems of arc discharge and cross talk, the present invention can further include a dielectric layer plated on the bonding pads of the FPC on the glass substrate, the X electrode terminals, the Y electrode terminals, and the coupling path formed between the bonding pads and the electrode terminals. The dielectric layer is also plated between the X electrode terminals and the Y electrode terminals as shown in FIG. 4, which is a schematic view of a PDP 40 of the present invention with a dielectric layer 68.

Referring to FIG. 3, the X electrodes and the Y electrodes are arranged in an alternate fashion and the display cells are formed between adjacent X electrodes and Y electrodes. If the X electrodes are numbered as X1, X2, . . . , Xn and the Y electrodes as Y1, Y2, . . . , Yn sequentially according to their layout arrangements on the glass substrate, then the first electrode pair is formed by X1 and Y1, the second electrode pair by X2 and Y2, . . . , and so on. In the PDP 30 of the present invention, the X electrodes 22 and the Y electrodes 24 are arranged in a interleave fashion Y1, X1, Y2, X2, Y3, X3, . . . , Yn, Xn; that is, except for the first and last electrodes, each X electrode is sandwiched between two Y electrodes and each Y electrode is sandwiched between two X electrodes. In the electrode arrangement of the PDP 30, each X-electrode has two neighboring Y-electrodes and each Y-electrode has two neighboring X electrodes, with the first electrode pair formed by X1 and Y1, the second electrode pair by X2 and Y2, . . . , and so on.

Figure 5:
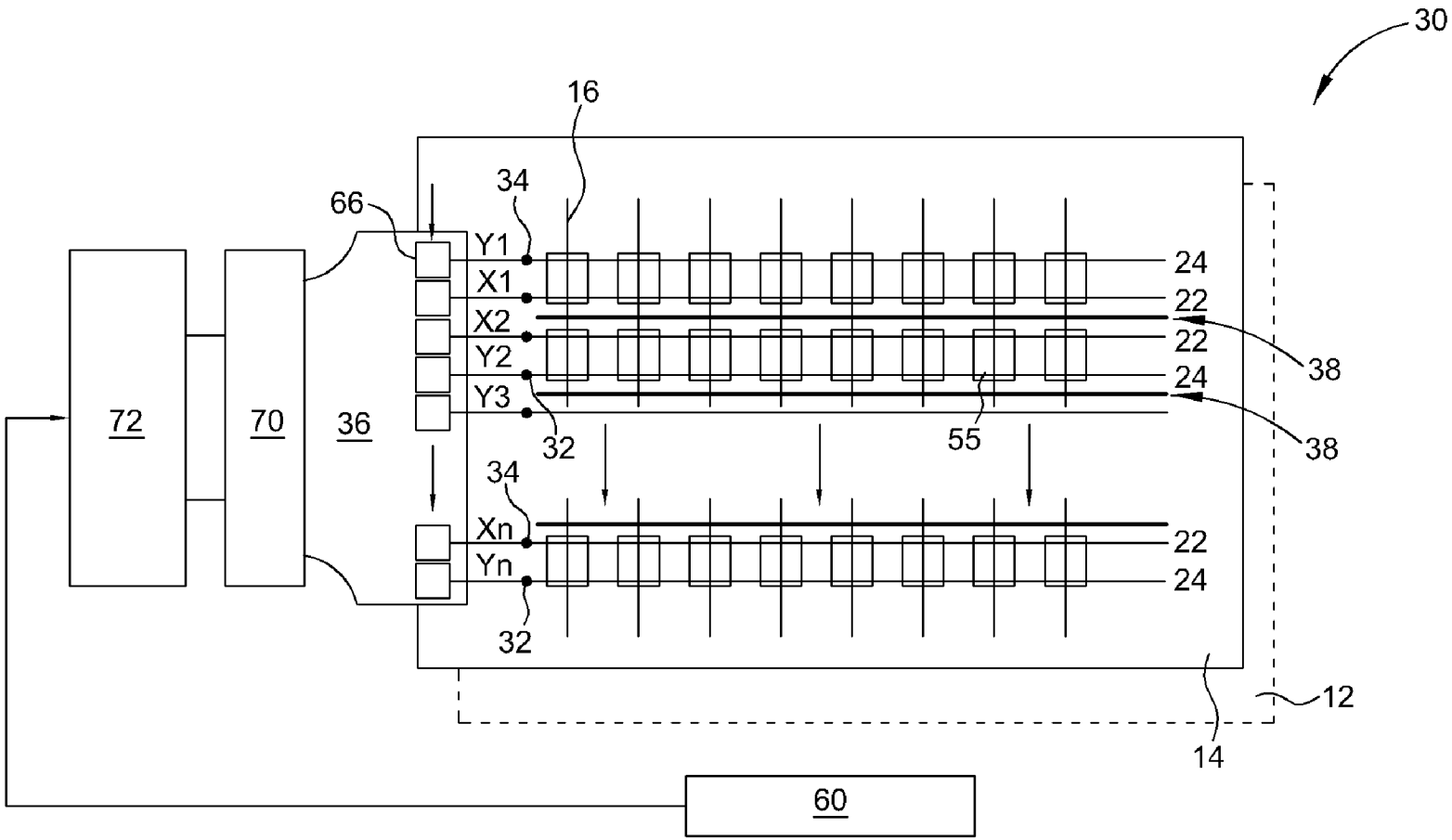
FIG. 5 is a schematic view of another embodiment of the PDP of the present invention.

Please refer to FIG. 5 for another embodiment of the present invention. A PDP 50 in FIG. 5 is different from the PDP 30 in the layout of the X electrodes 22 and the Y electrodes 24. In the PDP 50 the X electrodes 22 and the Y electrodes 24 are arranged in a sequence Y1, X1, X2, Y2, Y3, X3, . . . , Yn, Xn; that is, except for the first and last electrodes, two X electrodes are sandwiched between two Y electrodes and two Y electrodes are sandwiched between two X electrodes. In the electrode arrangement of the PDP 50, each X-electrode has one neighboring Y-electrode and each Y-electrode has one neighboring X electrode only, with the first electrode pair still formed by X1 and Y1, the second electrode pair by X2 and Y2, . . . , and so on. Since each electrode only has one neighboring electrode of the other type, the electrode arrangement in the PDP 50 can largely reduce arc discharges or cross talk between electrodes.

Compared to the prior, the present invention provides a PDP that only requires one FPC and one driving circuit. The present invention can lower manufacturing cost, simplify production flow, and improve the production yield. The present invention also solves the problems of signals with different delays from the control board to the driving circuits and the large magnetic interference contributed by the driving circuits at both sides of the glass substrate. In conclusion, the present invention features several advantages: low cost, simplified production flow, higher production yield, better PDP performance, and less magnetic interference.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A plasma display panel (PDP) comprising:

a first substrate and a second substrate disposed opposite to each other;

a plurality of first sustain electrodes and second sustain electrodes formed in parallel on the first substrate, the first sustain electrodes and the second sustain electrodes forming a plurality of sustain electrode pairs, the first sustain electrodes having a plurality of first electrode terminals and the second sustain electrodes having a plurality of second electrode terminals, the first and the second electrode terminals formed on a same end of the first substrate;

a plurality of address electrodes formed on the second substrate, the address electrodes extending in a direction intersecting the plurality of first sustain electrodes and second sustain electrodes;

a connecting circuit having a plurality of bonding pads formed at one side of the connecting circuit and coupled to the plurality of first electrode terminals and second electrode terminals;

a dielectric layer plated on the plurality of bonding pads, the pluralities of the first and second electrode terminals, and between the first and second electrode terminals; and only one driving circuit coupled to the connecting circuit for supplying driving voltages to the plurality of first sustain electrodes and second sustain electrodes.

2. The PDP of claim 1 further comprising a black matrix formed between two adjacent sustain electrode pairs.

3. The PDP of claim 1 wherein two adjacent first sustain electrodes are formed without a second sustain electrode positioned between the two adjacent first sustain electrodes.

4. The PDP of claim 1 wherein two adjacent first sustain electrodes are formed with a second sustain electrode positioned between the two adjacent first sustain electrodes.

5. The PDP of claim 1 wherein the connecting circuit is a single flexible printed circuit (FPC).

6. The PDP of claim 1 further comprising a control board coupled to the driving circuit for sending control signals to the PDP.

7. The PDP of claim 1 further comprising a scan integrated circuit (IC) coupled to another side of the connecting circuit.

8. The PDP of claim 7 further comprising a driving circuit coupled to the scan IC for supplying driving voltages to the plurality of first sustain electrodes and second sustain electrodes.

9. The PDP of claim 8 further comprising a control board coupled to the driving circuit for sending control signals to the PDP.

* * * * *